United States Patent [19]

Wilson

[11] Patent Number: 4,658,604

[45] Date of Patent: Apr. 21, 1987

[54] WARP KNITTED FABRIC AND METHOD OF KNITTING SAME

[75] Inventor: David Wilson, West Bridgford, England

[73] Assignee: Courtaulds Plc, London, England

[21] Appl. No.: 894,096

[22] Filed: Aug. 8, 1986

Related U.S. Application Data

[63] Continuation of Ser. No. 740,041, May 31, 1985.

[51] Int. Cl.[4] ..... D04B 21/00

[52] U.S. Cl. ..... 66/192; 66/195

[58] Field of Search ..... 66/190, 192, 193, 195, 66/202

[56] References Cited

U.S. PATENT DOCUMENTS

| | | | |
|---|---|---|---|
| 2,149,032 | 2/1939 | Schonfeld | 66/192 |
| 2,706,898 | 4/1955 | Gross et al. | 66/193 |
| 3,248,905 | 5/1966 | Krauss et al. | 66/192 |
| 3,552,155 | 1/1971 | Hartung | 66/192 |
| 3,910,075 | 10/1975 | Holliday | 66/192 |
| 3,922,888 | 12/1975 | Patterson | 66/192 |
| 4,044,575 | 8/1977 | Krug | 66/190 |

FOREIGN PATENT DOCUMENTS

| | | | |
|---|---|---|---|
| 2700673 | 7/1978 | Fed. Rep. of Germany | 66/192 |
| 370761 | 4/1932 | United Kingdom . | |
| 488606 | 7/1938 | United Kingdom . | |
| 513443 | 10/1939 | United Kingdom . | |
| 531335 | 1/1941 | United Kingdom . | |
| 860929 | 2/1961 | United Kingdom . | |
| 2005740 | 4/1979 | United Kingdom . | |
| 2037828 | 7/1980 | United Kingdom . | |

OTHER PUBLICATIONS

"Warp Knitting Technology", D. F. Paling, Columbine Press, 2nd Edition, 1965, pp. 231, 300 and 307.

*Primary Examiner*—Ronald Feldbaum

*Attorney, Agent, or Firm*—Howson and Howson

[57] ABSTRACT

Warp knitting of a stretch fabric suitable for outerwear end uses and simulating woven fabric is carried out to produce a coherent ground structure comprising non-elastomeric yarn, covered elastomeric yarns being laid into said ground structure.

12 Claims, 2 Drawing Figures

WARP KNITTED FABRIC AND METHOD OF KNITTING SAME

This application is a continuation of application Ser. No. 740,041, filed May 31, 1985.

TECHNICAL FIELD

This invention relates to a warp knitted stretch fabric suitable for outerwear end used, particularly in trousers, and to a method of knitting an outerwear fabric.

DISCUSSION OF PRIOR ART

In the course of development work to produce such a stretch fabric, trials were carried out involving laying into the warp knitted structure an elastomeric yarn to extend generally in the longitudinal direction of the fabric. The elastomeric yarn first chosen for trial was a bare polyurethane yarn but the fabric produced did not have an acceptable stretch performance. As an alternative, an elastomeric core plied yarn was tried. Such a yarn comprises an elastomeric filament twisted together with a spun yarn. Again the fabric produced was unacceptable in that it had a very rough surface.

The results obtained in the two trials mentioned above could easily have brought the development work to an end but perseverance with a third trial surprisingly showed that the use of a covered elastomeric yarn could produce an acceptable warp knitted fabric for outerwear end uses.

SUMMARY OF THE INVENTION

According to one aspect of the invention a warp knitted outerwear fabric comprising a coherent fabric structure knitted from a ground yarn and an elastic yarn laid into said fabric structure so as to extend generally in the longitudinal direction thereof, is characterised in that the fabric includes at least two covered elastomeric yarns each laid into a respective wale of the fabric with spaced excusions into an adjacent wale, such excursions of one of the covered elastomeric yarns taking place in courses different from such excursions of another, or the other, covered elastomeric yarn.

Preferably, the covered elastomeric yarn is a double covered yarn in which two strands of non-elastomeric covering yarn are separately wound about a core comprising an elastomeric strand.

Said coherent fabric structure may be a single bar structure, preferably a single bar structure with an underlap extending over two needle spaces.

According to a further aspect of the invention there is provided a method of warp knitting a fabric comprising forming a ground yarn into a coherent fabric structure and laying an elastic yarn into said fabric structure so as to extend generally in the longitudinal direction thereof, which is characterised in that the fabric is knitted as an outerwear fabric by steps including threading covered elastomeric yarns on at least two guide bars, causing each guide bar to make lapping movements such as to lay each covered elastomeric yarn into a wale of the fabric but with spaced excursions into an adjacent wale, such excursions of the covered elastomeric yarns laid by one of the guide bars taking place in courses different from such excursions of the covered elastomeric yarn laid by another of the guide bars.

To produce a stretch warp knitted fabric to simulate the appearance of a plain woven fabric, covered elastomeric yarns may be threaded on two guide bars each of which makes lapping movements such as to lay each covered elastomeric yarn into a separate single wale of the fabric with spaced excursions into an adjacent wale, such excursions of the covered elastomeric yarns from one of said two guide bars taking place in courses different from such excursions of the covered elastomeric yarns from the other of said two guide bars.

To produce a stretch warp knitted fabric to simulate the appearance of a twill, covered elastomeric yarns may be threaded on three guide bars each of which makes lapping movements such as to lay each covered elastomeric yarn into a separate single wale of the fabric with spaced excursions into an adjacent wale such that in every second course of the fabric, covered elastomeric yarns from two of said three guide bars make such an excursion but in no adjacent second courses is it the same two covered elastomeric yarns which are making such excursions.

BRIEF DESCRIPTION OF THE DRAWING

The invention will be further described, by way of example, with reference to the accompanying drawing in which.

DESCRIPTION OF PREFERRED EMBODIMENTS

Figure 1:
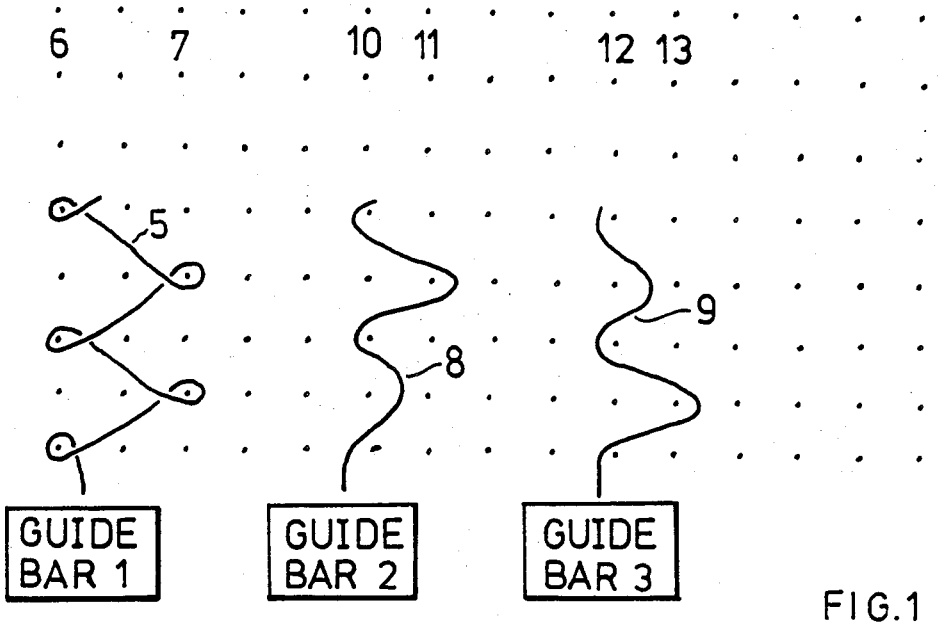
FIG. 1 is a lapping diagram for a fabric according to the invention simulating a plain woven fabric.

Both fabrics illustrated in the drawing are knitted from a ground yarn constituted by a textured polyester filament yarn and a laid-in covered, low-stretch, elastomeric yarn comprising a polyurethane filament core double covered with cotton yarn, two strands of cotton being separately wound about the polyurethane core.

Figure 2:
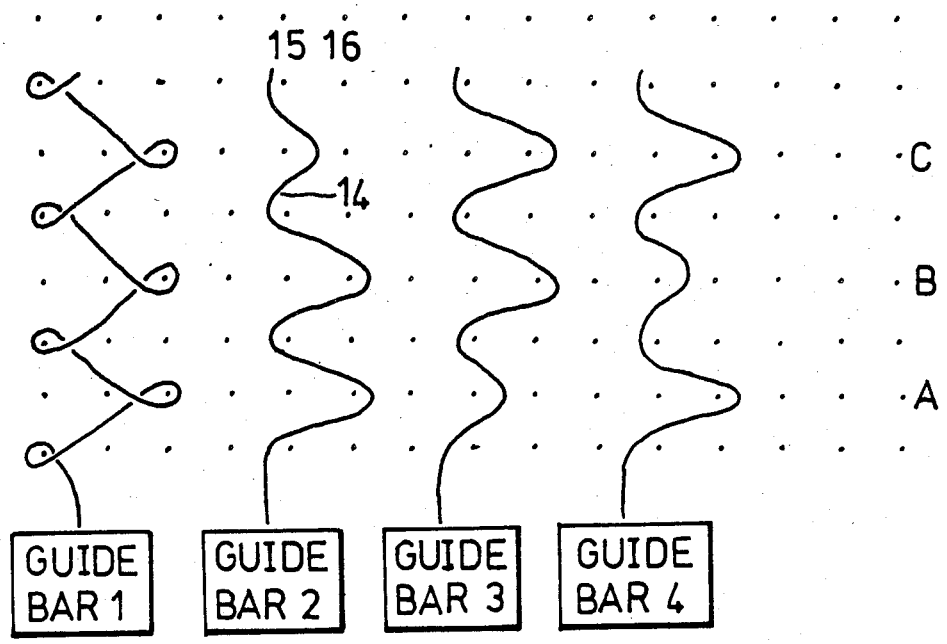
FIG. 2 is a lapping diagram for a fabric according to the invention simulating a twill.

In FIG. 1, the ground yarn is threaded in guide bar number one and the covered elastomeric yarn is threaded in guide bars numbers two and three. In FIG. 2, the ground yarn is threaded in guide bar number one and the covered elastomeric yarn is threaded in guide bars numbers two, three and four.

The lapping movements used in FIG. 1 are as follows:

| | |
|---|---|
| Guide bar 1 | 1-0/2-3/1-0/2-3 |
| Guide bar 2 | 0-0/1-1/0-0/2-2 |
| Guide bar 3 | 0-0/2-2/0-0/1-1 |

The lapping movements used in FIG. 2 are as follows:

| | |
|---|---|
| Guide bar 1 | 1-0/2-3/1-0/2-3/1-0/2-3 |
| Guide bar 2 | 0-0/2-2/0-0/2-2/0-0/1-1 |
| Guide bar 3 | 0-0/1-1/0-0/2-2/0-0/2-2 |
| Guide bar 4 | 0-0/2-2/0-0/1-1/0-0/2-2 |

In both the fabric of FIG. 1 and that of FIG. 2, the ground yarn forms a coherent fabric structure knitted on one fully-threaded guide bar with an underlap extending over two needle spaces.

In FIG. 1, covered elastomeric yarns are fully threaded on each of two guide bars each of which makes lapping movements such as to lay each covered elastomeric yarn into a separate single wale of the fabric but causes it at spaced intervals in the fabric to make excursions into an adjacent wale.

Thus, in FIG. 1, polyester filament ground yarn 5 is knitted in wales 6 and 7 two needle spaces apart so that the underlap in the fabric structure formed by the ground yarn extends over two needle spaces. The covered elastomeric yarns 8 and 9 (representative of the yarns from guide bars two and three respectively) are laid into the fabric of FIG. 1 to extend generally in the longitudinal (that is the wale) direction thereof. In fact, the yarn 8 is laid into wale 10 but in every fourth course of the fabric the second guide bar is moved to carry yarn 8 (and the other yarns threaded in the second guide bar) into the adjacent wale 11 and then back to wale 10. Similarly, the covered elastomeric yarn 9 is laid into wale 12 but in every fourth course of the fabric is carried by the third guide bar into the adjacent wale 13. The movements of the guide bars two and three are arranged so that the excursions of yarn 8 into the adjacent wale 11 take place in courses different from those in which the excursions of the yarn 9 into wale 13 take place and in fact these excursions take place in respect of one or other of the guide bars two and three every two courses so that a balanced fabric structure is produced; a course in which one set of laid in yarns moves to adjacent wales being followed by a course in which neither set does so, and then by a course in which the other set moves to adjacent wales and finally, to complete the cycle, there being a course in which neither set of laid-in yarns moves to adjacent wales.

Since all three guide bars are full-threaded, the ground yarn is knitted in every wale of the fabric and every wale of the fabric also has two covered elastomeric yarns laid into it which gives the fabric good covering power and a high superficial weight appropriate to an outerwear fabric.

In FIG. 2, covered elastomeric yarns are fully threaded on each of the guide bars, two, three and four. Each of the guide bars two, three and four follows a similar pattern of movements in sequence. The lapping movements set out above show that the movements of guide bar three follow, two courses behind, those of guide bar two and the movements of guide bar four follow, two courses behind, those of guide bar three. Each of these three guide bars lays each of its yarns, for example, yarn 14 from guide bar two into a single wale (15) with spaced excursions into an adjacent wale (16). In every second course of the fabric, yarns from two of the three guide bars two, three and four make such an excursion, the sets of yarns making the excursions being always different in adjacent second courses. Thus in course A, FIG. 2, yarns from guide bars two and four make lapping movements which take them to an adjacent wale (from wale 15 to wale 16 in the case of yarn 14). In the next course but one, B, yarns from guide bars two and three make a movement to an adjacent wale and in the next course but one after course B, in course C, the yarns from guide bars three and four make such a movement.

Warp knitted fabrics produced in the manner described above are particularly suitable for outerwear and have better stretch and recovery properties than can be achieved using textured yarns.

The knitted structures according to the invention described herein are such that the covered elastomeric yarn(s) is/are located in a surface of the fabric and thus can contribute to the surface texture and/or appearance of the warp knitted fabric.

What is claimed is:

1. A warp knitted outerwear fabric comprising a coherent fabric structure knitted from a ground yarn and including at least one elastic yarn laid into said fabric structure so as to extend generally in the longitudinal direction thereof, wherein said fabric includes (a) at least two sets of covered elastomeric yarns each supplied on a separate fully threaded guide bar so that at least two covered elastomeric yarns are laid into each wale of the fabric, and (b) each covered elastomeric yarn is laid into a single wale of the fabric but makes excursions at spaced intervals in the fabric into an adjacent wale, (c) said excursions of one covered elastomeric yarn taking place in courses different from the excursions of another covered elastomeric yarn, and (d) the knitted structure of said fabric being such that said covered elastomeric yarns are located in a surface of said fabric and contribute to the surface texture thereof.

2. A fabric as claimed in claim 1, wherein three sets of covered elastomeric yarns are supplied, each on a separate fully threaded guide bar, so that three covered elastomeric yarns are laid into each wale of the fabric with spaced excursions into an adjacent wale, said excursions taking place in a repeating pattern such that a different pair of covered elastomeric yarns make such an excursion in each one of every three successive courses of the fabric.

3. A fabric as claimed in claim 1, in which the covered elastomeric yarn is double covered yarn in which two strands of non-elastomeric covering yarn are separately wound about a core comprising an elastomeric strand.

4. A fabric as claimed in claim 2, in which the covered elastomeric yarn is double covered yarn in which two strands of non-elastomeric covering yarn are separately wound about a core comprising an elastomeric strand.

5. A fabric as claimed in claim 1, in which said coherent fabric structure is a single bar structure.

6. A fabric as claimed in claim 5, in which said coherent fabric structure is knitted with an underlap extending over two needle spaces.

7. A method of warp knitting a fabric comprising forming a ground yarn into a coherent fabric structure and laying an elastic yarn into said fabric structure so as to extend generally in the longitudinal direction thereof, wherein the fabric is knitted as an outerwear fabric by steps including (a) fully threading at least two guide bars of a warp knitting machine with covered elastomeric yarns, (b) causing each of said at least two guide bars to make lapping movements so as to lay at least two covered elastomeric yarns into each wale of the fabric and so as (c) to lay each covered elastomeric yarn into a single wale of the fabric but so that it makes excursions at spaced intervals into an adjacent wale, and wherein (d) such excursions of the covered elastomeric yarns laid by one of the guide bars take place in courses different from such excursions of the covered elastomeric yarns laid by another of the guide bars and (e) said covered elastomeric yarns are located in a surface of said fabric and contribute to the surface texture thereof.

8. A method as claimed in claim 7, including the steps of (a) fully threading a further covered elastomeric yarn on a further guide bar, (b) causing the further guide bar to make lapping movements with the other guide bars so as to lay three covered elastomeric yarns into each wale of the fabric with spaced excursions into an adjacent wale, and (c) effecting said excursions in a repeating pattern such that a different pair of covered elastomeric yarns make such an excursion in each one of every three successive courses of the fabric.

9. A method as claimed in claim 7, in which the covered elastomeric yarn is a double covered yarn in which two strands of non-elastomeric covering yarn are separately wound about a core comprising an elastomeric strand.

10. A method as claimed in claim 7, in which said coherent fabric structure is a single bar structure knitted with an underlap extending over two needle spaces.

11. A method as claimed in claim 8, in which said coherent fabric structure is a single bar structure knitted with an underlap extending over two needle spaces.

12. A method as claimed in claim 9, in which said coherent fabric structure is a single bar structure knitted with an underlap extending over two needle spaces.

* * * * *